United States Patent [19]

Gruner et al.

[11] Patent Number: 4,619,306

[45] Date of Patent: Oct. 28, 1986

[54] QUALITY CONTROL IN MULTIPLE CONTINUOUS CASTING PLANTS

[75] Inventors: Hans Gruner, Duisburg; Helmuth Orsech; Hans Schrewe, both of Düsseldorf, all of Fed. Rep. of Germany

[73] Assignee: Mannesmann Aktiengesellschaft, Duesseldorf, Fed. Rep. of Germany

[21] Appl. No.: 540,631

[22] Filed: Oct. 11, 1983

[30] Foreign Application Priority Data

Oct. 13, 1982 [DE] Fed. Rep. of Germany ..... 3238346

[51] Int. Cl.[4] ..... B22D 11/16

[52] U.S. Cl. ..... 164/150; 164/263; 164/269; 164/420; 164/451

[58] Field of Search ..... 164/4.1, 150, 151, 154, 164/155, 263, 413, 414, 451, 452, 454, 455, 418, 420, 269; 198/339

[56] References Cited

U.S. PATENT DOCUMENTS

| | | | |
|---|---|---|---|
| 3,614,978 | 10/1971 | Kosco | 164/413 |
| 4,005,744 | 12/1977 | Cofer et al. | 164/417 |
| 4,202,402 | 5/1980 | Röhrig | 164/263 |
| 4,397,384 | 8/1983 | Nohren, Jr. | 198/339 |
| 4,403,230 | 9/1983 | Gruner et al. | 164/4.1 |
| 4,483,433 | 11/1984 | Fischer et al. | 198/339 |

FOREIGN PATENT DOCUMENTS

| | | | |
|---|---|---|---|
| 56-36367 | 4/1981 | Japan | 164/154 |

*Primary Examiner*—Nicholas P. Godici
*Assistant Examiner*—Richard K. Seidel
*Attorney, Agent, or Firm*—Ralf H. Siegemund

[57] ABSTRACT

Multiple castings are cut into billets, combined in a transverse transport facility, separate into billets to be inspected or not, recombined and cooled. Transportation includes two transverse facilities and two longitudinal facilities, combined in various combinations. The transportation is carried out with only one, or no, pivoting action and cooling is provided for alongside one of the multiple transport paths with overall accommodation to subsequent transport of billets out of the system.

18 Claims, 4 Drawing Figures

QUALITY CONTROL IN MULTIPLE CONTINUOUS CASTING PLANTS

BACKGROUND OF THE INVENTION

The present invention relates to continuous casting and more particularly to a casting machine which includes molds proper and torch cutters for cutting one or more continuous castings into sections and which further included facilities for transporting the individual casting length or lengths from their withdrawal path. Moreover, the equipment of the type to which the invention pertains includes cooling facilities as well as facilities for marking of the individual castings.

Continuous casting therefore includes basically the casting facilities proper as well as subsequent handling of the castings particularly with regard to cutting the basically endless casting into manageable sections; handling further includes active cooling so that the individual lengths can be handled more easily as soon as possible. It is further known to include basically into the overall equipment inspection facilities for detecting any defects whereby again it is advisable to eliminate potential rejects as soon as possible. The problem exists to manage casting sections in an economical manner from the instant of casting up to the time of transporting cast billets out of the casting facility.

DESCRIPTION OF THE INVENTION

It is an object of the present invention to provide a new and improved casting facilities of the type to which the invention pertains, the improvement being related to low cost inspection procedure particularly under consideration that if defects can be detected very early after the casting it should be possible to intervene in the casting and/or cooling process as soon as possible in order to reduce the total amount of rejects.

It is another object of the present invention to improve the inspection of multiple castings and to improve further the controlling of intervening process being instituted as a result of such inspection such that any intervention remains minimal as far as the overall casting operation is concerned and may effect only a single casting line.

It is a specific object of the present invention to improve facilities for continuous castings of multiple castings in parallel casting paths under utilization of plural molds and plural cutters, for separating each individual casting string into a series of billets, and for handling such billets afterwards.

In accordance with the preferred embodiment of the present invention it is suggested to provide a first, primary, billet gathering at transversely operating transport facility cooperating with all of the casting paths and withdrawal paths for the individual, parallely emerging castings but being disposed downstream from the cutters as provided, in order to receive all of said billets, the billets; being disposed on this transport facility and moved transversely to the direction of extension. On account of the parallel disposition of casting paths, billets which have been cut from castings and which have emerged from different molds will be spatially separated on that transverse transport facility in the direction of transportation and movement of this first transversely operating facility; an inspection line and path is arranged alongside the first transversely operating transport facility, and billets which have been branched off will pass through that inspection line are moved in a longitudinal direction of their extension which is in fact transversely to the direction of movement of and within the first transport facility. This inspection line includes a plurality of inspection stations which test, for example, the surface and surface near regions of any billet under utilization of different physical phenomena, in order to search for any defects. This inspection line may include a descaling facility upstream from the testing proper and the inspection line may include downstream marking facilities operating in response to any conducted test to identify any billet that has passed through the inspection line and was found to be defective; the identification may include particularization of the type of defect involved.

A second and also transversely operating transport facility is arranged downstream from the inspection line to take a billet out of the inspection line and move that billet transversely to its direction of extension; a third transport facility is coupled to the two first mentioned facilities for combining billets that have passed through the inspection line with those which have not. Downstream from the third transport facility there is arranged a cooling facility for receiving all of said billets as combined and cooling them down to a temperature which makes further handling less difficult. A separating station may be provided downstream from the cooling facility to separate billets found to be defective and being appropriately marked from those which either have not been inspected or which have been found to contain no defect.

The particular procedure involved here for purposes of detecting defects can be used in a hierarchical manner for purposes of controlling subsequent processes which eliminate more or less superficial surface defects; alternatively the geometry of the arrangement is such that any billet found to be defective can be traced directly and immediately to the particular mold of continuous casting from which it emerged, and a temporary shutdown of that mold may, at that point, be advisable without affecting any of the other, parallely operating casting paths. The method in accordance with the invention is such that an early recognition of errors and defects can be provided so that the casting process can be intervened to remedy any causes of the defects. In more severe cases, it may be necessary to shut down the entire equipment, particularly if defects occur within several, maybe even all of the billets that emerge from different casting paths.

The inventive concept is realizable in a variety of manners which constitute overlapping subcombinations. The combinations vary in the orientation of the several transport paths in relation to each other, in relation to the direction of casting, in relation to the direction of passing billets through the cooling station and in relation to the ultimate disposal and transportation of the billets away from the immediate environment.

In accordance with the first approach, the first transversely operating transport facility is, so to speak, the principal transport facility in that billets to be inspected are taken off that facility, transported to and through the inspection line, displaced laterally and returned back to the first transport facility so that inspected as well as uninspected billets are taken off the first transversely operating transport facility to be placed into the cooling facility. This cooling facility extends either alongside the first mentioned transport facility which is a direction transversely to the direction of casting or it extends parallely to the inspection path whereby prefereably a pivotable transfer mechanism moves inspected as well as uninspected billets from the extended first transport facility to the cooling device. In this particular type of arrangement, inspection may be carried out on the same side as casting as far as the first principal transport facility is concerned or on the other side thereof.

In the second approach the billets are taken from the first transport facilities in parallel paths, one path being the inspection path, the other one being a longitudinal transport path for unninspected billets. Billets taken out of the inspection path are combined with uninspected billets in a second transport path and the cooling station is either directly in line with extension of the second extended transport path or the cooling path extends parallel to the inspection path, and a pivotable transfer station transfers inspected and uninspected billets from the extended path for to the cooling station.

The inspection generally may include an entrance station in which the billets are descaled and downstream from the descaling one or more of the following stations ar provided: an optical type station that searches for longitudinal cracks; an eddy current tester which searches for cracks in and below the surface of the billet; and a flame tester which searches for pores and includsions. Other types of testing can be provided if deemed necessary. A marking station is provided downstream from all of these testing devices and may just mark a billet that was found to be defective for any reason, but the marking may include more particular identification of the type of defect that was found to exist. This marking permits subsequent sorting of billets into defective and undefective billets.

It is essential for the invention that the inspection of billets and flaw and defect detection occurs as early as is possible in order to intervene in the casting process very soon after such defects appear. A preliminary operation, for example, may include a sampling of billets as to defects; in the case a defect is found, a more thorough inspection may be conducted involving possibly many, some or all of the billets which are propagating through the system following a billet that was found to be defective. On the basis of this kind of improved or enhanced or accelerated inspection, a decision may be made as to whether or not any kind of intervention in the casting process is needed, whether or not a single casting line is affected only, or whether or not the entire casting process is, to some extent, subject to an error condition so that a total shutdown is required.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings, in which:

Proceeding now to the detailed description of the drawings, FIG. 1 illustrates a casting machine 16 being provided, for example, with a common tundish and six molds from which emerge respectively six castings or casting strings 16*a, b, c, d, e* and *f*. The castings are withdrawn individually on roller tracks in the conventional manner and veered into the horizontal. At some point downstream from the casting molds there are arranged torch or flame cutters 14 which cut the basically endless strings into series of individual slab ingots or billets. These billets arrive in parallel paths, and in laterally displaced relation, at a transverse transport facility 6 onto which which they are placed. Each of them resides briefly on the facility, particularly for purposes of affixing in a suitable manner identifying insignia, codes, markings or the like to each of these billets and they are transversely transported in the direction of arrow 6*a*. In view of the inherently necessary lateral spacing of the casting paths, the individual billets are spaced in the direction of this transverse transportation.

Figure 1:
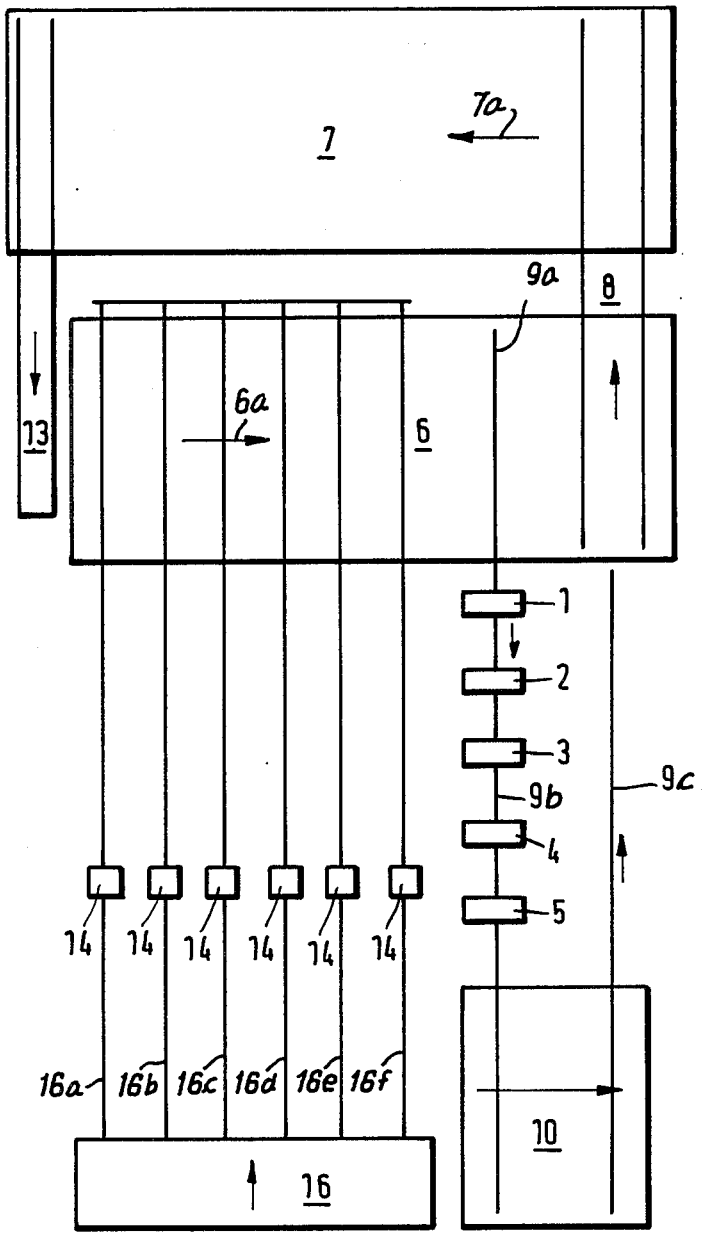
FIG. 1 is a schematic plan view of a device and equipment for continuous casting of six castings in parallel with inspection provided for alongside the casting and transverse cooling facility behind the equipment.

The billet gathering and collecting, transverse transport facility 6 may be a roller track or belt or the like and runs each individual billet past the entrance section 9*a* of a longitudinally operating roller track 9*b*. If an individual billet, which may be an occasional one or every billet if that is desired (infra) is to be subjected to a quality control, then the transport facility 6 will stop briefly when the particular billet is aligned with the entrance 9*a*, and the longitudinal transport facility 9*b* will move the billet off the transport facility 6 into an inspection path. The longitudinal transport facility 9*b* constitutes in fact the inspection path, and various testing devices therealong establish the inspection line. This inspection path and line along the transport path 9*b* will be described shortly. Presently it should be mentioned that if a billet has past through the inspection line it enters another transverse transport facility 10 to move such a billet into alignment with a return at longitudinal transport facility 9*c* by means of which the particular billet can be moved back onto facility 6. The longitudinal transpsort facility 9*c* may be in line with a longitudinal roller track 8 which is also the recipient of any uninspected billet which is being moved by the transport facility 6 and is not shifted into the inspection path 9*b*. The roller track 8 connects in effect the transport facility 6 as well as the transport conveying path 9*c* with a cooling facility 7 in which the individual billets are cooled through appropriate movement along the arrow 7*a*. Please note, that the right hand portion of facility 6 extends the latter so as to combine inspected with uninspected billets.

Returning now to the inspection path 9*b*, it includes a final station 1 for descaling the individual billets, any billet is still quite hot at that point. A first inspection and detection station 2 is provided downstream from the descaler 1. The inspection device 2 may be of the optic/electronic variety for purposes of detecting and recognizing longitudinal cracks in the surface of the billet. A further inspection station 3 is provided downstream from the station 2 in order to inspect the surface means interior of the billet. Station 3 may for example operate on the basis of induction of eddy currents; flaws, defects, inclusions or the like effect the formation of eddy currents which is an externally observable phenomena. A flaming machine 4 with optic/electronic evaluation is provided downstream from the eddy current station 3 in order to search for pores and inclusions. The last station in the inspection line is a marking station 5 which is provided in order to affix in a suitable manner a marking on any billet in which a defect has been found. That marking should be such that subsequently suitable detection equipment can readily distinguish between a marked and unmarked billet. Moreover, the marking may identify the type of defect that was detected.

The particular configuration of the inspection line is presented here by way of example only and includes the typical and most common types of inspection. Additional stations may be provided, for example, for taking a sample from the billet which is then directly subjected to chemical or physical analysis, or for probing deeper into the interior of the billet. It can also be seen that the marking station 5 must be functionally correlated with the inspection and flaw detection processes so that the faulty billet will be marked correctly. Also, it should be noted that timing and phasing of inspection and marking is essential to correlate any defective billet with a particular casting line. Stations 2 and 3 as stated inspect a billet for surface and surface-near defects, particularly of the crack and fissure variety, while the flaming device 4 searches for pores and slag inclusion in surface-near regions of the billet by means of the formation of a flaming line.

As was mentioned earlier, any billet that has been run through the inspection sequence is returned to the transport facility 6 via the facilities 10 and 9*c*, and any billets, i.e., those which have been inspected and those which have not been inspected are passed to the cooling bed 7 for further transport. It can also be seen that the transportation of billets through the facility 6 is interrupted only for those brief instances in which billets are taken on and off the facility 6. Proper dimensioning and timing and phasing of the operation will make sure that no undue overlap occurs.

It can readily be seen that the device 1 through 4 and here particularly, the input for the marking station 5 represents a measuring result being indicative of the absence or presence of one or more defects whereby due to the differences in detecting techniques involved different types of defects can be already recognized. This, then, constitutes an early recognition and coarse typologizing of defects permitting at that point intervention in the casting process. In this regard, it should readily be understood that due to the geometry of the equipment involved and due to accurately controlled sequencing of the operation including, particularly, the placement of billets into the transport facilities generally the recognition of a defect in a particular billet permits immediate and direct recognition and identification of the particular molds and casting branch from which the defective billet emerged. Another important aspect is that in the case of an defect recognition, possibly of a particular type of defect, the inspection sequence may be immediately altered so that each and every on of the billets which follows the billet that was found defective, is now also being inspected which for an recognition whether or not there is a basic fault within the casting equipment or whether or not defects occur in one casting line only. In either case, early recognition of any defect permits localization of the source of the error, and the casting can be intervened if that is appropriate. Moreover, an individual line may have to be shut down which does not at all effect the operation of the other lines. Of course, if every billet in sequence is found to be defective, the problem may be very severe and the entire equipment may have to be shut down. But it can readily be seen that this severe intervention in the casting process as a whole is by no means necessary just because a single billet was found defective, or, if upon further intensified inspection billets of one line or casting are found to be consitently defective.

Another result of detection, and particularly of flaw recognition typology may permit other remedies, for example, surface flaming of a billet in a post-casting procedure. Moreover, any burnoff losses in billets resulting from flaming can be offset, at least to some extent, through optimizing the casting line and string distribution. In this regard one may, for example, delay temporarily the cutting in one line by means of the cutter 14 until the passing string has increased in length by a requisite corrective parameter, which is longer than on a normal steady state operations, but offsets the burn-off as conducted subsequently.

The system depicted in FIG. 1 illustrates, in addition, a sorting facility 13 at the downstream end of the cooling facility 7. This sorting facility 13 may include a detector which searches for marking on billets indicating that the particular billet is defective and the recognition of that marking can be used in sorting station 13 to separate the particularly marked billet from the others, i.e. from those which have either been found to contain no defect or which have not be inspected at all.

As stated, the inspection line provides for a variety of inspections permitting correspondingly certain identification of the type of defect that was detected. The marking provided by the station 5 may not merely mark a billet to be defective but may also identify the type of defect. This, in turn, may permit subsequently a supplemental treatment of the respective billet in order to eliminate the defect, if that is at all possible. In this regard it may occur that certain minor defects occur, possibly even periodically, but they are not significant enough to intervene in the casting process simply because a post treatment, particularly a supplemental surface treatment, readily suffices for the elimination of the result of the defects. Moreover, even in cases in which the defects are sufficiently severe to warrant intervention in the casting process in some form, those billets which are found to be defective may possibly still be saved in this manner. Thus there is an overlap of potential remedies and the equipment permits the making of weighted decisions in one way or the other.

Figure 2:
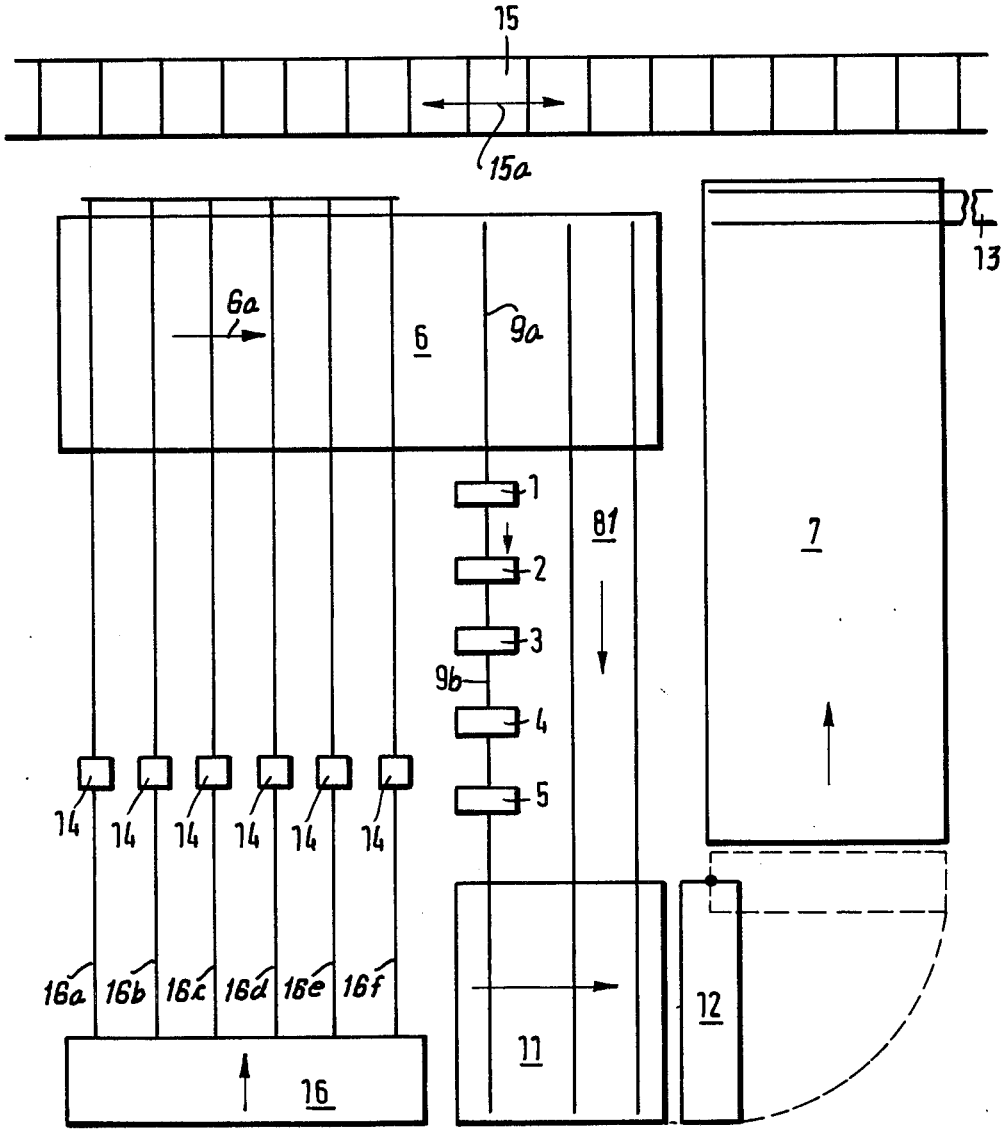
FIG. 2 is a similar plan view of a six line casting facility with parallely arranged inspection facility and a cooling facility arranged alongside thereof.

FIG. 2 illustrates a casting facility in which the elements 16, 14, 6, 1 through 5 and 9*a* are similar or actually the same as shown in FIG. 1. However, the operation following inspection and the handling of uninspected billets are carried out somewhat differently. In this particular example billets exit from the transport facility 6 in two parallel paths, one being the inspection line 9*a* and 9*b* as described leading to a second transverse transport facility 11 while a longitudinal transport path 81 runs uninspected billets in parallel to the line 9*b* and also to the transverse facility 11 which therefore combining inspected as well as uninspected billets and moves them to a transfer station 12.

A billet is placed laterally onto the transfer station 12 which is then pivoted around a vertical axis, i.e. in a horizontal plane by, say, 90° to deliver the billet to the cooling tank or the like 7. They cooling tank extends also parallel to the two paths 9*b* and 81. The exit or discharge side of the cooling facility 7 leads again to the sorting station 13 as before.

The particular arrangement as depicted in FIG. 2 is characterized by a high degree of compactness and may be of advantage with regard to a particular overall layout of the plant and the building or hanger in which the facility, as depicted and described, has been arranged. The arrangement is of particular significance, for example, if an overall transport facility is provided such as railroad tracks 15. The various billets will be transported by means of cars which run on these tracks. From an overall point of view it can be seen that the double arrow 15*a* illustrates the transport path direction for the removal of the billets from the casting facility while for reasons of internal layout the casting direction extends actually transverse to that direction of transportation.

The railroad tracks 15 may, for example, run in parallel and alongside the so-called hanger ship. The presently contemplated association of the transport equipment with the existing facility for the ultimate transport of the billet is very important because the overall arrangement is such that the discharge and exit end of the cooling facility 7 delivers particularly oriented billets. These billets pass through the cooling facility at an orientation wherein their direction coincides with the ultimate direction of transport in order to avoid a further pivotting of the billets. Therefore, the further transport can be carried out with a single hanger crane. Please note, that the multiple handling and transport facility requires that the billets are pivoted by 90° only *once* from the direction of casting into an orientation parallel to the direction of ultimate transport as represented by the railroad tracks 15.

Figure 3:
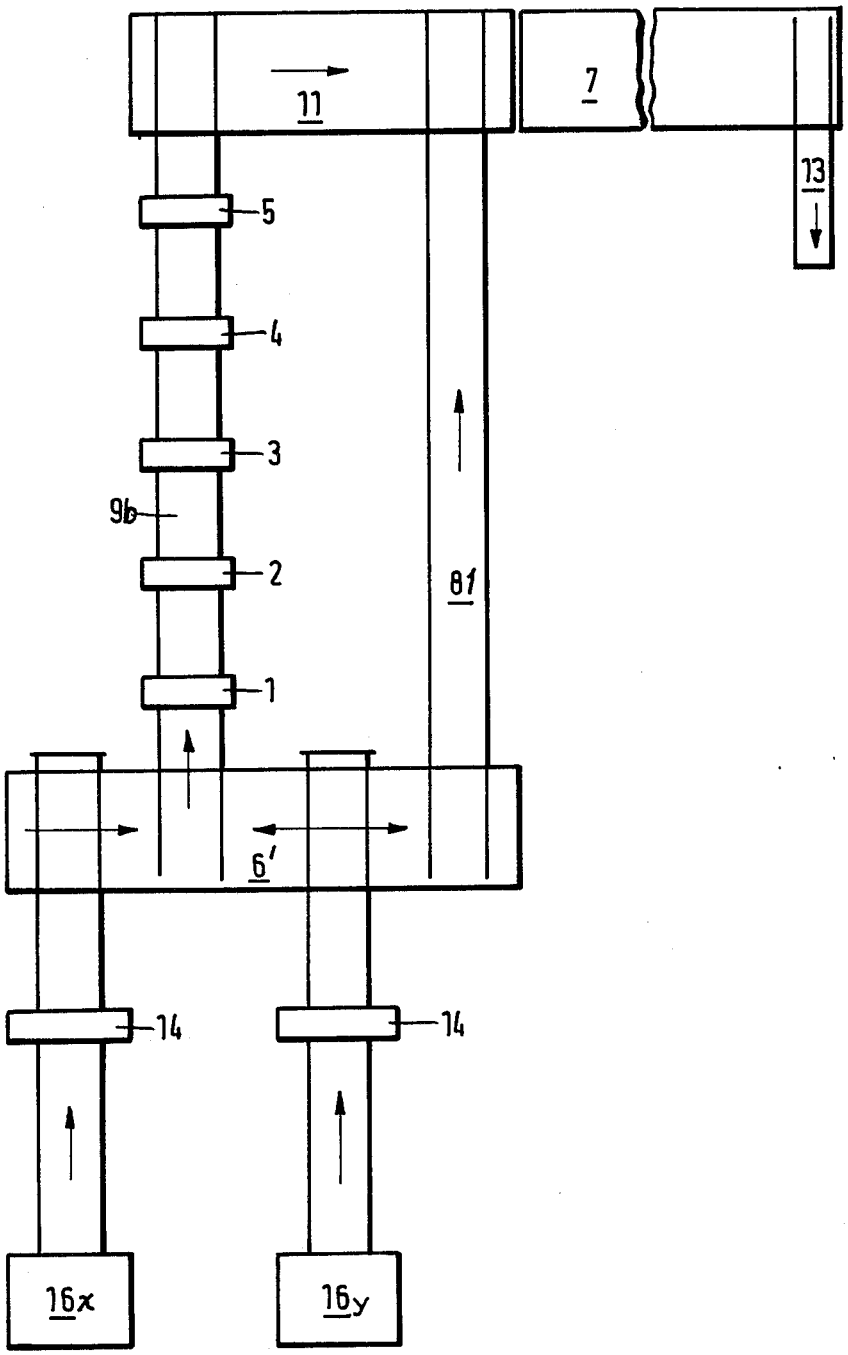
FIG. 3 illustrates a two line casting machine with inspection provided in line with the casting and laterally displaced and transversely arranged cooling facility.

FIG. 3 illustrates two parallely operating but otherwise independent casting molds 16*x* and 16*y*. There are accordingly two parallel transport paths for the casting and each path includes a cutter 14, there being accordingly a somewhat simplified transverse facility 6'. This particular transverse conveyor facility 6' is a reversable one so that individual billets can be placed either in line with the inspection path 9*b* or with the parallely positioned roller track 81; both of them transporting billets in longitudinal direction and cooperate on their respective exit side with the transverse facility 11. The extension of that transverse facility 11 feeds directly the cooling tank 7 being in line therewith at cooperating with a sorting station 13 as aforedescribed.

Figure 4:
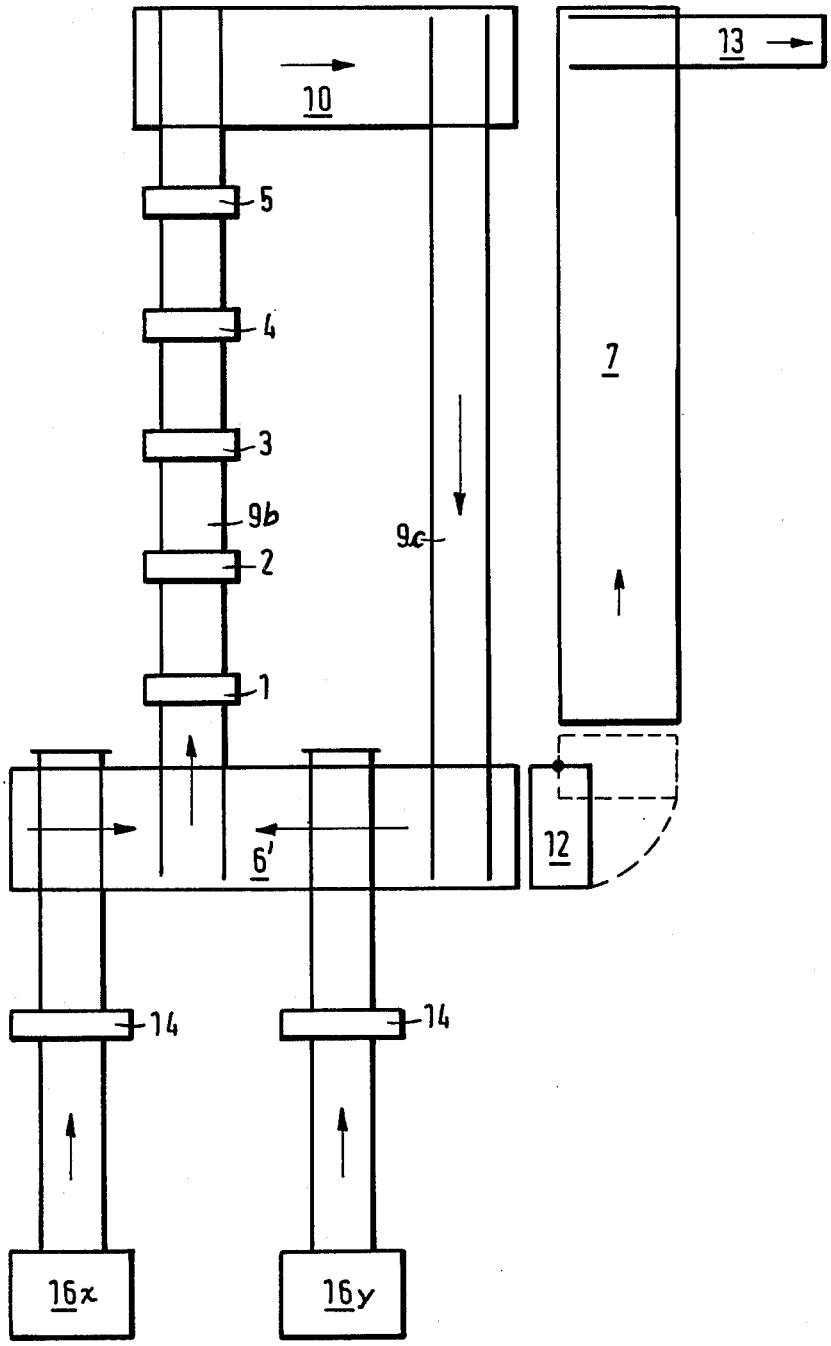
FIG. 4 is a plan view of a two line casting facility with in-line inspection and parallely arranged cooling.

FIG. 4 illustrates a variation of the facility shown in FIG. 3. Again it is a two line casting facility but the end of the inspection line 9*b* feeds the transverse transport facility 10 by means of which the inspected billets area placed onto the return path 9*c*, so as to return billets to the primary billet gathering facility 6'. The reversable transverse facility 6' feeds again a transfer station 12 which pivots each billet by 90° whereby of course again inspected and uninspected billets are involved and the billets are passed through the cooling facility 7 and into the sorting station 13. In other words, that portion is similar to the facility shown in FIG. 2.

It can be seen, therefore, that in that particular example, the transverse facility 6' has taken over the function of the longitudinal roller tracks 81 in FIGS. 2 and 3 and also of the longitudinal track 8 in FIG. 1. Therefore, this is a simplified arrangement, but the number of casting paths is lower. The particular arrangement of FIG. 4 has the same advantage as the one shown in FIG. 2 with regard to the further transportation of the billets out of the hanger wherein the particular direction of transportation runs transversely to the direction of casting.

It can thus be seen that the inventive concept permits conduction of a quality control and inspection of still hot billets, still within the immediate vicinity of the casting machine proper and without hampering the overall material flow within the entire device and system. This way a rather intensified quality control is provided which is carried out in very close temporal association with the casting process proper, so that error and defect recognition permits immediate intervention in the casting process in a controlling fashion. Moreover, any defective billets which, in effect, means defective portions of a continuous casting string can be removed and separated from the other billets just after cooling because it may well be possible to save defective billets through appropriate supplemental treatment.

It can readily be seen that in the examples of FIGS. 1, and 4 the primary or initial transverse transport facility (6 or 6'), collecting all of the billets that have been cast, has an extension in which the inspected billets are combined with uninspected billets. The second transverse transport facility in these cases thus feeds inspected billets to a longitudinal transport path (9*c*) that returns inspected billets to the primary billet gathering facility (6 or 6'). The examples of FIGS. 2 and 3, however, show that inspected and uninspected billets are combined in an extention of a transeverse facility at the end of the inspection line 9*b*, and a longitudinal transport path 81 feeds uninspected billts to the combining extension of that additional transverse transport facility.

The cooling station 7 can be arranged alongside the primary billet-gathering facility (FIG. 1); along the inspection (FIGS. 2 and 4); or in line with the combining facility (FIG. 3). The inspection can be carried out alongside the casting (FIGS. 1, 2), or on the other side of the billet-gathering facility 6 (FIGS. 3, 4).

The invention is not limited to the embodiments described above but all changes and modifications thereof, not constituting departures from the spirit and scope of the invention are intended to be included.

We claim:

1. In a facility for continuous casting of multiple casting strands in parallel, there being a plurality of molds and corresponding cutters for forming and separating each casting strand in a line and path of casting from the molds, into respective billets, the improvement comprising:

a first transversely operating transport means cooperating with all said casting paths to receive all of said billets in spaced apart relation but transporting them into a common direction extending transversely to the respective direction of casting of each of the billets as defined by the respective casting path;

an inspection line parallel to the casting paths and transverse to the first transport means and including a second longitudinal transporting means for selectively receiving and transporting specified billets to be inspected from said first transport means and moving the received billets to the inspection line there being at least one inspection station arranged along the inspection line;

a third transport means coupled to both the inspection line and to the first transverse transport means for transporting inspected billets as well as uninspected billets; and a cooling facility connected to the third transport means for receiving all of said billets from the said third transport means and as combined therein, for purposes of cooling.

2. In a facility as in claim 1 the third transport means including a continuation of the first transport means including a fourth longitudinal transport means extending parallel to the inspection line and leading to said continuation; and a fifth transversely operating transport means interconnecting the inspection line and the fourth longitudinal transport facility.

3. The improvement as in claim 2 said fourth longitudinal means and said inspection line extending in parallel to the direction of casting.

4. The improvement as in claim 2, the cooling facility extending parallel to and alongside said longitudinal casting paths, there being a pivotting transfer station interposed between the third transport means, and the facility for cooling.

5. The improvement as in claim 2, the cooling facility extending parallel to said first transverse transport facility, the third transport means including a longitudinal track interconnecting the continuation of the transverse transport facility and the cooling facility.

6. The improvement as in claim 1 wherein the third transport means includes a fifth transverse transport means in which inspected and uninspected billets are combined and further includes a fourth longitudinal transport facility connected to the first transverse transport facility and extending parallel to the inspection path, for feeding uninspected billets to the fifth transport means.

7. The improvement as in claim 6, the cooling facility extending parallel to said inspection line and to said fourth longitudinal transport means, there being a pivotting transfer station interposed between the third transport means and the facility for cooling.

8. The improvement as in claim 6, the cooling facility extending in direct alignment with the fifth transport means as far as direction of transportation of the billets is concerned which is transversely to the predominant direction of extension of the casting paths.

9. The improvement as in claim 1, wherein said inspection path extends in parallel to the direction of casting and on the same side of the transverse transport facility but the direction of transport through the inspection path runs in a direction opposite to the direction of casting.

10. The improvement as in claim 9 wherein the third transport means includes a continuation of the first transport means as well as a fourth longitudinal transport means extending parallel to the inspection line and further including a fifth transport means to feed billets from the inspection line to the fourth longitudinal transport means, the fourth means casing inspected billets to be combined with uninspected billets on the continuation of the transport facility.

11. The improvement as in claim 9, wherein the third transport means includes a fifth transverse transport means and a fourth longitudinal transport means connected to the first transport means and extending parallel to the inspection path, for feeding uninspected billets to the fifth transverse transport means which combines them with inspected billets for feeding to the cooling facility.

12. The improvement as in claim 1, wherein said inspection path extends in parallel to the direction of casting and the billets move in the same direction, the inspection path and the casting path being situated on opposite sides with respect to the first transport means accordingly.

13. The improvement as in claim 12, wherein the third transport means includes a continuation of the first transport means as well as a fourth longitudinal transport means extending parallel to the inspection line for moving billets to the continuation, the third transport means further including a fifth transport means to transversely transport billets from the inspection line to the fourth longitudinal transport means, the latter causing inspected billets to be combined with uninspected ones on the continuation of the first transport means.

14. The improvement as in claim 12 wherein the third transport means includes a fifth transverse transport facility ans further includes a fourth longitudinal transport facility connected to the first transverse transport means and extending parallel to the inspection path for moving billets from the first to the fifth transport means, the latter moving all of the billets to the cooling facility.

15. The improvement as in claim 1 and further including a billet sorting facility arranged downstream from the cooling facility.

16. The improvement as in claim 1, the inspection line including at least one of the following, an electronic/optical surface scanner for detection of longitudinal cracks in any of the billets which pass through the inspection line;

an eddy current testing device for electrodynamic interaction with surface and surface-near regions in the billet passing through the inspection path;

a flaming device with optical/electronic evaluation for the detection of pores and inclusions.

17. The improvement as in claim 16, the inspection station further including a descaling facility disposed upstream from any of said stations.

18. The improvement as in claim 16, the inspection station further including a defect marking device disposed downstream from any of the inspecting stations.

* * * * *